United States Patent [19]

Nakazawa et al.

[11] Patent Number: 4,688,871

[45] Date of Patent: Aug. 25, 1987

[54] LOCKING DEVICE FOR CONNECTOR

[75] Inventors: Akira Nakazawa; Shigeru Kikuta; Kihachiro Koike; Kensaku Matsuoka; Yoshimitsu Nishino, all of Tokyo, Japan

[73] Assignees: Hirose Elec. Co., Ltd; NEC Corp.; Japan Aviation Elec. Industry Limited, all of Tokyo, Japan

[21] Appl. No.: 848,316

[22] Filed: Apr. 4, 1986

[30] Foreign Application Priority Data

Apr. 4, 1985 [JP] Japan ..... 60-50184[U]

[51] Int. Cl.[4] ..... H01R 13/631

[52] U.S. Cl. ..... 439/357

[58] Field of Search ..... 339/91 R, 75 R, 75 M

[56] References Cited

U.S. PATENT DOCUMENTS

| | | | |
|---|---|---|---|
| 3,020,513 | 2/1962 | Quackenbush | 339/91 R |
| 3,149,897 | 9/1964 | Martineck | 339/91 R |
| 4,113,179 | 9/1978 | McKee | 339/91 R |
| 4,361,374 | 11/1982 | Marmillion et al. | 339/90 R |
| 4,367,002 | 1/1933 | Waghorn et al. | 339/90 R |
| 4,477,135 | 10/1984 | Pronto | 339/14 R |

*Primary Examiner*—John McQuade

*Attorney, Agent, or Firm*—Harry M. Weiss & Associates

[57] ABSTRACT

A locking device for locking the coupling of a connector plug with a connector receptacle comprises a metal engaging piece provided at one of the connector plug and receptacle and a resin engaging portion provided at the other to be engaged by the metal engaging piece. A metal piece is mounted on the engaging part of the resin engaging portion.

2 Claims, 2 Drawing Figures

LOCKING DEVICE FOR CONNECTOR

BACKGROUND OF THE INVENTION

1. Field of the Invention

This invention relates to an improvement in a locking device for a connector.

2. Description of the Prior Art

Heretofore, in order to lock a connector plug with a connector receptacle, a locking device is provided in a connector. The locking device has in general an engaging piece and an engaging portion to be engaged by the piece. Most connector plugs have metal engaging pieces due to restrictions in size and strength, and most connector receptacles have resin engaging portions due to workability, assembling property and a reduction in the number of parts.

When one engaging piece is formed of metal and the other engaging portion is formed of resin, as in the conventional example described above, the resin engaging portion tends to be damaged or worn, by repeated locking and unlocking and the locking function often fails in a relatively short time.

An object of this invention is to provide a locking device for a connector capable of eliminating the above-mentioned disadvantages of the conventional device by providing very simple structure capable of performing locking for a long period of time.

SUMMARY OF THE INVENTION

According to this invention, there is provided a locking device for locking the coupling of a connector plug with a connector receptacle, comprising a metal engaging piece provided at one of the connector plug and receptacle and a resin engaging portion provided at the other to be engaged by the metal engaging piece, characterized in that a metal piece is mounted on the engaging part of the resin engaging portion.

This invention will now be described in further detail with regard to preferred embodiments as illustrated in the accompanying drawings.

DESCRIPTION OF THE PREFERRED EMBODIMENTS

Figure 1:
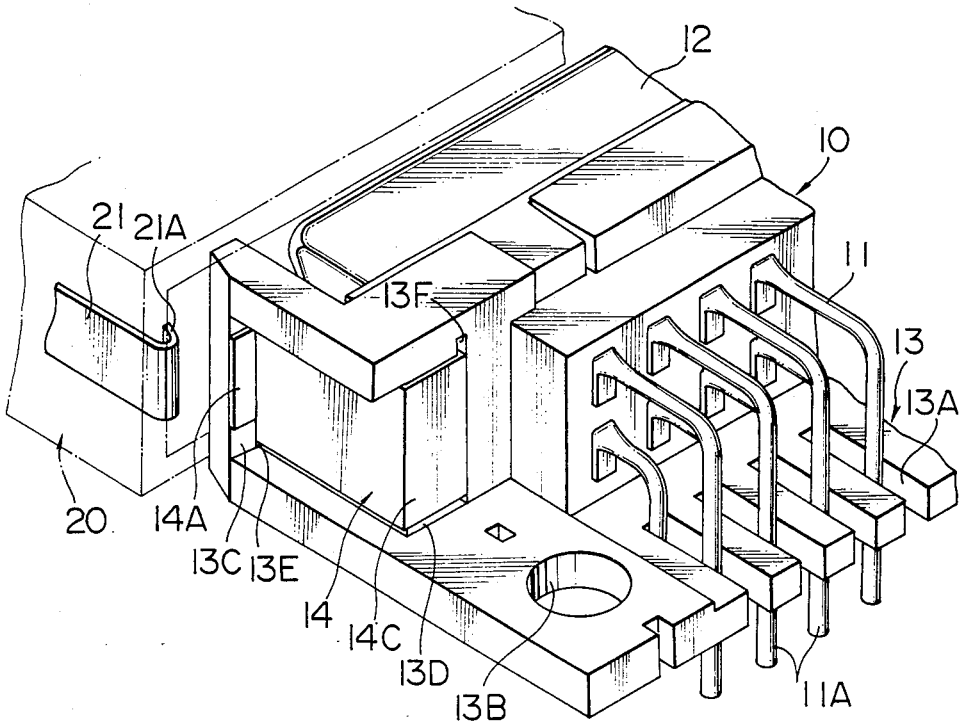
FIG. 1 is a view partly showing a connector applied with the locking device of an embodiment of this invention.

FIG. 1 partly shows a connector applied to a locking device according to a preferred embodiment of this invention. As shown in FIG. 1, a connector receptacle 10 has a resin base 13 providing a receptacle engaging portion 12 for arraying and holding the female contacting portions of one end of a plurality of female contactors 11. The base 13 is also formed with grooves 13A for passing printed base connectors 11A of the other ends of the contactors 11. The base 13 is also formed at both sides thereof with openings 13B for inserting lock pins for fixedly holding the receptacle 10 on a printed board.

Further, the base 13 is also formed, in the vicinity of both side front ends thereof, with engaging steps 13C as resin engaging portions for forming parts of the locking device.

A connector plug to be engaged with the receptacle 10 is contained in a connector plug case 20. Plug case 20 is formed with metal lock springs 21 at both sides thereof as metal engaging pieces for forming parts of the locking device. The lock spring 21 is bent at the front end thereof in a hook shape, and the hooked portion 21A locks with the engaging step 13C when the connector plug is engaged with the receptacle.

According to this invention, a lock retaining bracket mounting shoulder 13D, to be contacted with the engaging step 13C, is formed at the base 13, mounting slots 13E are formed at both deep sides of the step 13C, and a mounting slot 13F is formed at the deep portion of the shoulder 13D. The lock retaining bracket 14 is mounted by utilizing the shoulder 13D, and the slots 13E, 13F.

Figure 2:
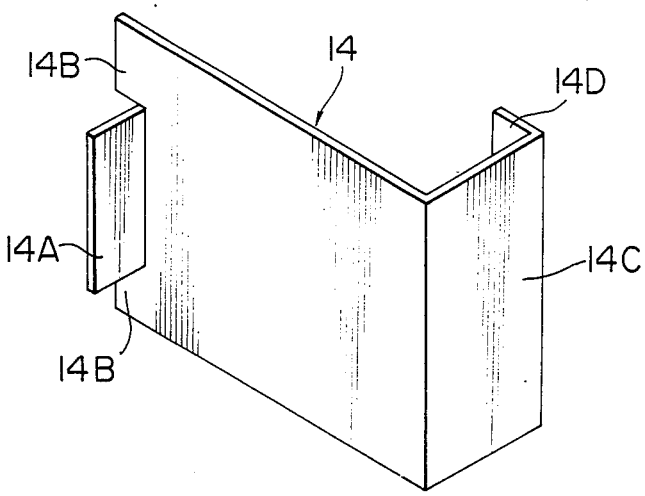
FIG. 2 is a perspective view showing a lock retaining bracket used for the locking device of FIG. 1.

The bracket 14 is formed in a generally "L" shape, as shown in a perspective view of FIG. 2. Bracket 14 is preferably made of a metal sheet, and has a metal piece 14A is disposed at one end of bracket 14 and is bent substantially perpendicularly from the widthwise intermediate of bracket 14 and opposite in direction from bent leg portion 14C. Metal piece 14A is, thereby, configured to engage the surface of central portion of step 13C with stationary pieces 14B disposed at each side of metal piece 14A being configured to insert into and engage slot 13E. A lower leg portion 14C of generally "L"-shaped bracket 14 is disposed at another end of bracket 14 and extends generally perpendicularly therefrom and opposite in direction from metal piece 14A. A stationary mounting member 14D is further disposed at a distal end of lower leg portion 14C and is bent substantially perpendicularly to lower leg portion 14C and towards bracket 14. Stationary mounting member 14D is configured to insert into and engage with slot 13F of connector receptacle 10.

According to this invention, since the simple bracket is inserted into the lock engaging portion of resin side, the resin side is not work at lock engaging and disengaging times, and even if the connector is pulled by strong force in the connector engaging and disengaging directions in the locking state, the resin engaging portion is not cut nor damaged. Therefore, the locking device of this invention can perform a complete locking function over a long period even with very simple structure.

What is claimed is:

1. A locking device for holding a coupling between a connector plug and a connector receptacle, comprising:

a metal engaging piece disposed on one of the connector plug and the connector receptacle, a resin engaging portion disposed on the other of the connector plug and the connector receptacle to be engaged by said metal engaging piece, wherein said resin engaging portion further comprises an engaging step extending transversely in direction to the direction of the coupling of the connector plug with the connector receptacle at the coupling end and a lock retaining bracket mounting shoulder disposed distally from said engaging step relative to the coupling direction, said lock retaining bracket mounting shoulder further extending in a direction opposite to that of said engaging step, wherein said engaging step and said lock retaining bracket mounting shoulder each further comprise a mounting slot disposed thereon, and a generally L-shaped lock retaining bracket formed of a sheet metal, said lock retaining bracket comprising a planar main portion, a lock retaining metal piece extending perpendicularly from a widthwise central portion of one end of said planar main portion and forming mounting pieces extending from said planar main portion, a first lower leg portion extending perpendicularly from another end of said planar main portion and in an opposite direction from that of said lock retaining metal piece, and a second lower leg portion extending generally perpendicularly from a free end of said first lower leg portion, whereby said lock retaining bracket is mounted on and fixed to said resin engaging portion by inserting said mounting pieces extending from said main portion into said mounting slot of said engaging step and inserting said second leg portion into said mounting slot of said lock retaining bracket mounting shoulder so that said lock retaining metal piece is adjacent to sad engaging step to directly receive said metal engaging piece for engaging with said resin engaging portion and said first lower leg portion is placed over and adjacent to said lock retaining bracket mounting shoulder.

2. A locking device as claimed in claim 1, wherein said metal engaging piece is provided at the connector plug, and said resin engaging portion is provided at the connector receptacle.

* * * * *